United States Patent [19]

Karr

[11] 4,434,949

[45] Mar. 6, 1984

[54] WINDER RIDER ROLL CONTROL

[75] Inventor: Gerald W. Karr, South Beloit, Ill.

[73] Assignee: Beloit Corporation, Beloit, Wis.

[21] Appl. No.: 356,633

[22] Filed: Mar. 10, 1982

[51] Int. Cl.[3] ..... B65H 17/12

[52] U.S. Cl. ..... 242/66; 242/68.7; 464/28; 464/85

[58] Field of Search ..... 242/66, 65, 68.7; 464/79, 80, 85, 89, 28; 74/574

[56] References Cited

U.S. PATENT DOCUMENTS

| | | | |
|---|---|---|---|
| 1,815,639 | 7/1931 | Wilkin et al. | 464/28 |
| 2,167,705 | 8/1939 | Batten | 464/28 X |
| 2,677,508 | 5/1954 | Locke | 242/66 |
| 2,733,018 | 1/1956 | Nitchie | 242/66 |
| 2,972,241 | 2/1961 | Hackforth | 464/28 |
| 3,604,649 | 9/1971 | Riittulanmaki | 242/66 |
| 3,818,721 | 6/1974 | Wahlmark | 464/111 |
| 3,858,820 | 1/1975 | Crouse | 242/66 |
| 3,986,589 | 10/1976 | Ochi et al. | 464/28 X |
| 4,095,485 | 6/1978 | Hiersig | 464/89 X |
| 4,165,843 | 8/1979 | Wedig et al. | 242/66 |

FOREIGN PATENT DOCUMENTS

| | | | |
|---|---|---|---|
| 1182909 | 12/1964 | Fed. Rep. of Germany | 464/28 |
| 1208953 | 1/1966 | Fed. Rep. of Germany | 464/28 |
| 2532833 | 1/1977 | Fed. Rep. of Germany | 464/76 |
| 1346685 | 11/1963 | France | 464/28 |
| 43-23561 | 10/1968 | Japan | 464/85 |
| 983521 | 2/1965 | United Kingdom | 464/76 |
| 1335663 | 10/1973 | United Kingdom | 464/85 |
| 573635 | 9/1977 | U.S.S.R. | 464/28 |
| 632867 | 11/1978 | U.S.S.R. | 464/28 |
| 773327 | 10/1980 | U.S.S.R. | 464/28 |

*Primary Examiner*—Stuart S. Levy
*Assistant Examiner*—Scott J. Haugland
*Attorney, Agent, or Firm*—Hill, Van Santen, Steadman & Simpson

[57] ABSTRACT

A winder rider roll assembly for paper rolling devices is provided with a rider roll having a counter weighting system in which chains affixed adjacent axial ends of the rider roll assembly are entrained over chain sprockets non-rotatably affixed to a cross shaft mechanism with one sprocket for each chain being affixed to one piece of a two piece cross shaft with the cross shaft pieces being torsionally connected through a variable spring rate coupling employing selectively inflatable air bags for transmission of torsional forces. Also disclosed is a method of controlling the level and force of the rider roll by varying air pressure in the air bags of the variable spring rate coupling.

11 Claims, 5 Drawing Figures

WINDER RIDER ROLL CONTROL

BACKGROUND OF THE INVENTION

1. Field of the Invention

This invention relates to rider roll assemblies, and particularly to rider roll assemblies for paper winding devices.

2. Prior Art

Paper winding devices which wind paper on a paper roll core frequently utilize parallel rotating winder drums with the paper passed between a nip formed between the roll core and the winder drums. Rotation of the winder drums causes rotation of the paper roll core and the spiral wrapping of the paper around the core. As the roll of paper builds, the core position with respect to the winder drums changes to reflect the increasing diameter of the paper roll. In order to control nip pressure, initially between the paper roll core and winder drums and later between the paper roll itself and winder drums, a rider roll may be urged against the paper roll core, initially, and later the paper roll, in a direction to affect the nip pressure.

The rider roll must be capable of movement away from the winder drums to allow for increase in paper roll diameter. Moreover, since the nip pressure is increased as the diameter of the paper roll increases as a result of the increased weight of the paper roll, means are normally provided for controlled reduction of the rider roll force as the paper roll weight increases. Further, in order to allow removal of the roll of paper from the winder drums, it is necessary to remove the rider roll from any position of interference. To this end rider rolls are frequently carried by a rider roll beam assembly having sufficient mass to provide the maximum initial nip force. The rider roll beam is normally movable in a beam guide in directions towards and away from the paper roll core. To provide fur such movement, chains are affixed to the rider roll beam adjacent axial ends of the beam. The chains are entrained over a common cross shaft having chain engaging sprockets non-rotatably affixed thereto. The chains, after passing over the sprockets, are then connected to a rider roll force and position control system which may, for example, include pneumatic cylinders and counter weights.

By use of a common cross shaft having sprockets engaged by the chains from each end of the rider roll beam, with the sprockets non-rotatably affixed to the cross shaft, the cross shaft can function as a torsional rider roll level maintenance device.

Frequently, as the paper roll begins for form, due to minute paper thickness differences along the transverse width of the paper and/or other reasons including rider roll nip force, one side of the paper roll may increase in diameter at a rate greater than the other side. When this occurs the rider roll will tend to become unlevel or non-parallel to the axis of the paper roll. In such a situation the cross shaft will act as a torsion bar to reduce the nip pressure at the low end of the rider roll and increase it at the high end and will thereby seek to maintain the rider roll level. This can, however, in some instances, result in damage to the paper by providing an undesired nip pressure at either the high or the low end. Too high a nip pressure at the high end of the rider roll can result in paper stretching while too low a nip pressure at the low end can result in a loose wrap which can allow paper shifting to occur between successive windings.

In spite of the possible occurrence of such deficiencies in the use of torsion cross shafts, such shafts are desired in the maintenance of desired levelism of the rider roll as well as for the provision of some increase in nip force at the high end of the paper roll.

It would therefore be an advance in the art to provide a rider roll assembly which utilizes a torsion shaft for maintenance of rider roll levelism, but in which the nip force disparity between high and low ends of the rider roll is responsive to the degree of diameter difference between the high and low ends of the paper roll and which can be controlled.

It would be a further advantageous advance to provide a rider roll system where the initial levelism of the rider roll could be adjusted and where nip pressures at the respective ends of the rider rolls could be varied.

SUMMARY OF THE INVENTION

This invention overcomes deficiencies inherent in prior art torsion shaft rider roll support assemblies by providing a two piece cross shaft with a chain sprocket non-rotatably affixed to each piece of the cross shaft and with the cross shafts interconnected by means of a variable spring rate coupling employing selectively inflatable air bags. Also provided is an apparatus and control system for varying the pressure within the air bags to provide for variability in the neutral position of the shaft portions with respect to one another, to provide for adjustment of the torsion force transmission rate of the coupling and to vary nip force across the rider roll.

In the preferred embodiment illustrated the cross shaft consists of first and second axially aligned rotatable shaft members having opposed axial ends which are interconnected by the coupling. The coupling consists of collars affixed to the shafts adjacent their opposed ends having radially extending circumferentially spaced projections. Each projection is separated from a circumferentially spaced projection by a trough area with circumferentially fore and aft ends of the projections provided with offset pads for connection to air bags. The projections of one collar are aligned with the troughs of the other collar such that the pads of the projections of one collar will be opposed by pads of the projections of the other collar. Air springs are entrapped between the pads belonging to different projections with the pads projecting radially inwardly into the troughs.

In this manner, circumferential relative rotation of one collar with respect to the other collar will cause certain of the air bags to be compressed while expanding other of the air bags. Thus, as one of the cross shaft portions is caused to rotate by rotation of the rider roll chain sprocket affixed thereto, torque force will be transmitted through the variable spring rate coupling via compression of certain of the air bags to the second shaft portion. The actual torque force transmitted for a given degree of initial rotation is proportional to the initial pressure of the gas contained in the air bags. By use of a compressible gas in the air bags, the degree of torsional resistance to relative rotation can be both accurately predicted and controlled. Moreover, the torsional resistance will increase in a known manner with increases in relative rotation between the shaft portions.

In order to provide for selective control of torsional force transfer through the coupling, each of the air bags is provided with a valve with the air bags which will be compressed for one direction of relative rotation being in communication with one gas pressure source and the air bags which will be compressed by the opposite direction of relative rotation being in communication with a second source of gas pressure. Valves are provided for adjusting the pressure to the different sets of air bags such that the bags can be selectively initially inflated. Changes in initial inflation will change the resistance to relative rotation of the collars. By providing different air pressure sources to the different sets of bags resistance to relative rotation in the two different directions of relative rotation can be initially set at different levels.

Moreover, by providing different initial pressure settings to the two sets of bags, the angular rest or neutral position of the shaft portions relative to one another can be adjusted. In this manner, the initial leveling of the rider roll can be fine tuned by control of the initial bag pressure setting. Conversely, if, for any reason, it is desired to have an out of level setting for the rider roll, this also can be accomplished by varying the pressures in the two sets of bags.

By use of a variable pressure setting system for the bags in the coupling, other desirable changes can be made in the control of the rider roll and its nip pressure. For example inputs from load sensors on the chains can be utilized to control the pressure settings of the two bag sets in a manner to either equalize loads at the ends of the rider roll or to vary the relative loads. Additionally, by sensing the relative rotation of the two shaft portions by sensing relative positioning of the collar projections, out of level of the rider roll and/or the paper roll diameter can be observed automatically and by utilizing an input from that sensing to a control panel can be compensated for if desired.

Further, in order to allow maximum useability of such a system, the collars can, in the preferred embodiment, be rotationally adjustable on the shaft portions. In this manner, the initial set of the coupling can be widely varied to provide for accurate desired setting of the position of the rider roll.

It is therefore an object of this invention to provide an improved winder rider roll assembly having improved rider roll leveling and nip load force control means.

It is another, and more specific object of this invention to provide an improved winder rider roll assembly utilizing a torsion shaft between rider roll supporting chain engaging sprockets with the shaft having two separate portions connected together through a variable spring rate coupling.

It is another, and more particular object of this invention to provide a rider roll assembly including a torsion cross shaft in the support assembly for the rider roll, the cross shaft being formed in two portions being connected together by a variable spring rate coupling and the variable spring rate coupling employing torsion force transmission through a plurality of individually pressureizable gas bags.

It is another specific object of this invention to provide a torsion cross shaft for paper winder rider roll assemblies with the shaft including two axially aligned separate shaft portions interconnected through a variable spring rate coupling having circumferentially spaced, inflatable torsion force transmitting gas bags, the gas bags including first and second sets with the first set being compressed by relative rotation in a first angular direction and the second set being compressed by relative rotation in the second angular direction opposite the first angular direction and separate pressure supplying means to each set of bags with control means for controlling the pressure to each set of bags.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
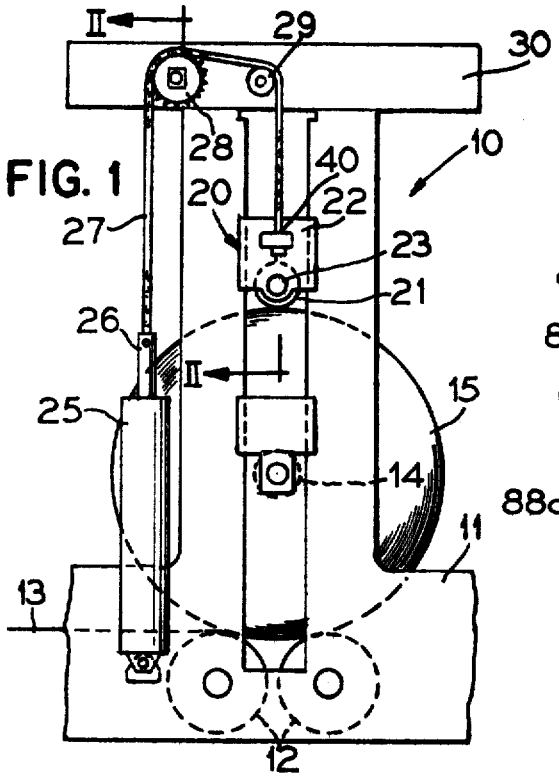
FIG. 1 is a fragmentary side view of a winder roll assembly employing a rider roll having a torsional cross shaft according to the present invention.

FIG. 1 illustrates generally a winder and rider roll assembly 10 including frame means 11. It is to be understood that the particular winder assembly and rider roll assembly shown in FIG. 1 are illustrative only and that the invention is utilizable in winder-rider roll devices of other design. The winder section includes winding drums 12 which are powered for rotation, in FIG. 1, in a clockwise direction. An entering sheet of paper or the like 13 may pass in the nips between the winder drums 11 and the paper roll core 14 to form a paper roll 15 around the core, the roll 15 being rotated by the winder drums. The paper roll core 14 may include an axis member which is horizontally held by slide blocks 16 received in vertical guide channels of frame means 11 so that the paper roll core 14 can move vertically to accomodate the differing diameters of the paper roll 15.

A rider roll assembly 20 is provided on the side of the core 14 opposite the winder drums 12. The rider roll assembly may include rider roll 21 carried by a rider roll beam 22, the beam having end configurations which may also be received in the guide slots of frame means 11 restricting horizontal movement of the rider roll beam, and thus the rider roll. The rider roll is carried by a bearing assembly 23 at each end of the rider roll whereby the rider roll 21 is free to rotate. The rider roll beam may have a sufficiently large mass to bias the rider roll 21 against the roll of paper 15, or initially against the roll core 14, to force the paper roll against the winder drums to maintain the paper roll in position within the nips of the winder drums while also providing an adequate nip force to insure the proper winding of a tight roll.

Since it is necessary for the rider roll to move vertically as the paper roll increases in dimension, the rider roll beam will be guided by the vertical guide slots. However, it is also necessary to remove the rider roll from contact with the paper roll to allow the paper roll to be ejected from the winder drums and, further, since the mass of the paper roll will increase as the roll diameter increases, and therefore the nip force at the winder drums will also increase, mechanism is normally provided to both lift the rider roll assembly for paper removal and to provide a lifting counter force to the rider roll beam mass which can be varied in relation to the diameter of the paper roll. To provide such rider roll lifting, FIG. 1 illustrates a pneumatic or hydraulic system including cylinders 25 having telescoping powered piston rods 26 affixed to the ends of chains 27. The cylinders 25 may be affixed to frame means 11 and the chains train over sprockets 28 and sheaves or sprockets 29 carried by a top cross beam 30 of the frame member. The chain ends 40 are then attached at the outboard ends of the rider roll beam. Thus, by controlling the degree of projection of the rod 26, and the force of withdrawal of the rod 26, both the vertical positioning of the rider roll and the force that it exerts against the paper roll 15 can be varied.

It will be understood, of course, that the rider roll lifting and force balancing system shown in FIG. 1 is a simplified example of such systems and that other, more complex systems are frequently utilized, including massive counter weights for the rider roll and beam and distance multiplying systems for the lifting counter force, however, the basic principle of control of the nip force while allowing movement of the rider roll in a direction away from the growing paper roll is common to rider roll systems presently utilized.

Figure 2:
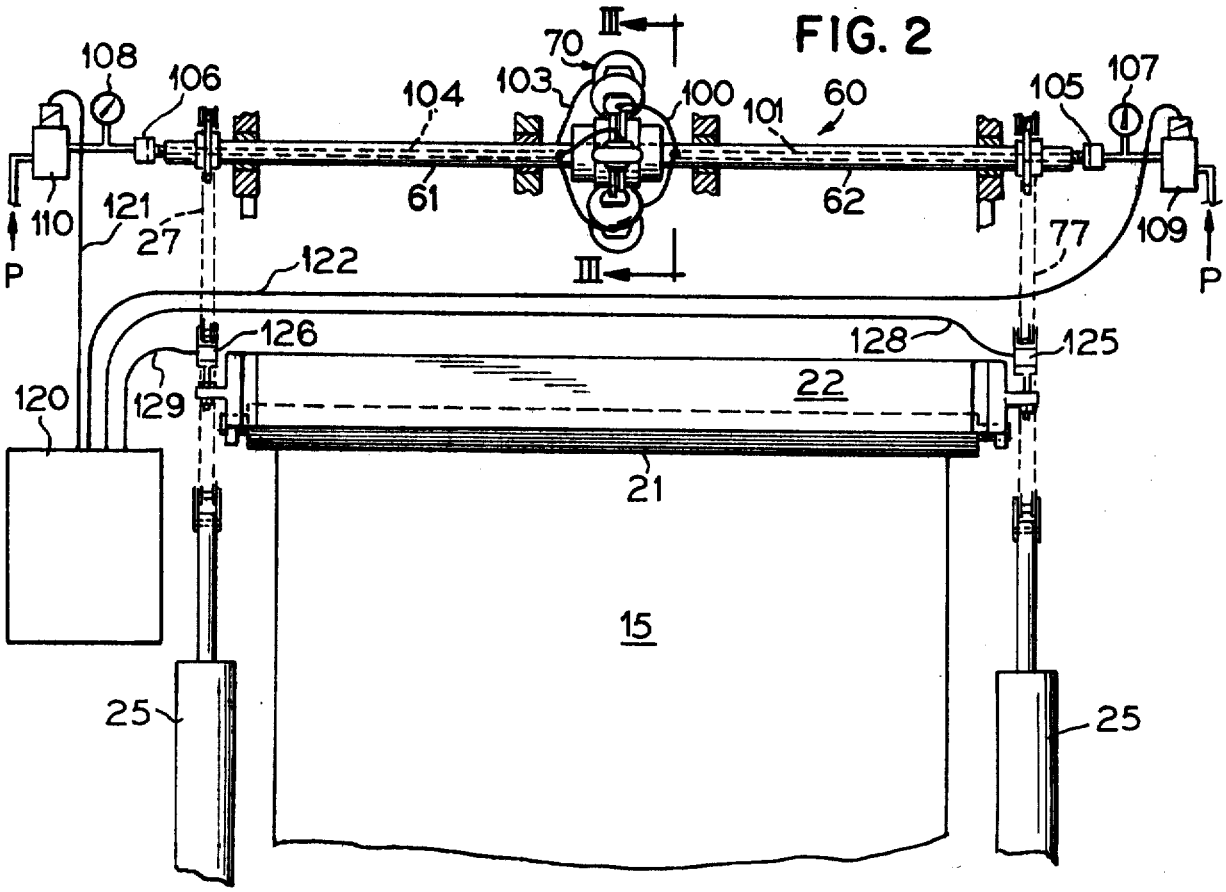
FIG. 2 is a fragmentary sectional view taken along the lines II—II of FIG. 1 and schematically illustrating a control system for pressure setting of the gas bags of the variable spring rate coupling of the cross shaft.

As best shown in FIG. 2, the rider roll 21 extends across the full width of the paper roll 15 and may extend beyond the ends of the paper roll. The rider roll beam 22 extends longitudinally beyond the rider roll. In modern paper manufacturing, such winder-rider roll assemblies have become extremely long. It is therefore quite possible that one end portion of the paper roll 15 may increase in diameter a rate different than other portions, and particularly the opposite end portions of the paper roll. When this occurs the rider roll 21, in attempting to conform to the outer diameter of the paper roll, will begin to become unlevel. In order to prevent this, it has been known to utilize a cross shaft assembly 60 which includes a solid or hollow shaft non-rotatably affixed to the sprockets 28 carrying the chains 27 at each end of the rider roll assembly. Thus, as one end of the rider roll beam is elevated at a rate different than the other end of the rider roll beam, the cross shaft would be rotated a greater degree at that one end. Because the cross shaft would torsionally resist rotation by engagement with the sprocket at the other end, and the control of rotation of the sprocket by the chain, the back torque through the cross shaft would have the effect of increasing resistance to further rotation at the high end. This would, in effect, increase the nip force at the larger diameter end portion. At the same time nip force at the smaller end would decrease to the extent that increased nip force could cause the paper roll to tend to maintain proper roll diameter growth, the nip force increase was beneficial. However, to the extent that the nip force exceeded tolerances, damage could occur to the paper.

This invention, in order to overcome this, provides a variable spring rate coupling 70 and a two piece cross shaft 60 consisting of axially aligned shafts 61 and 62 which are connected by the coupling 70. In the embodiment illustrated in FIG. 2, the shafts 61 and 62 are approximately of equal lengths and therefore the coupling 70 is positioned approximately midway between the ends of the winder-rider roll assembly.

Figure 5:
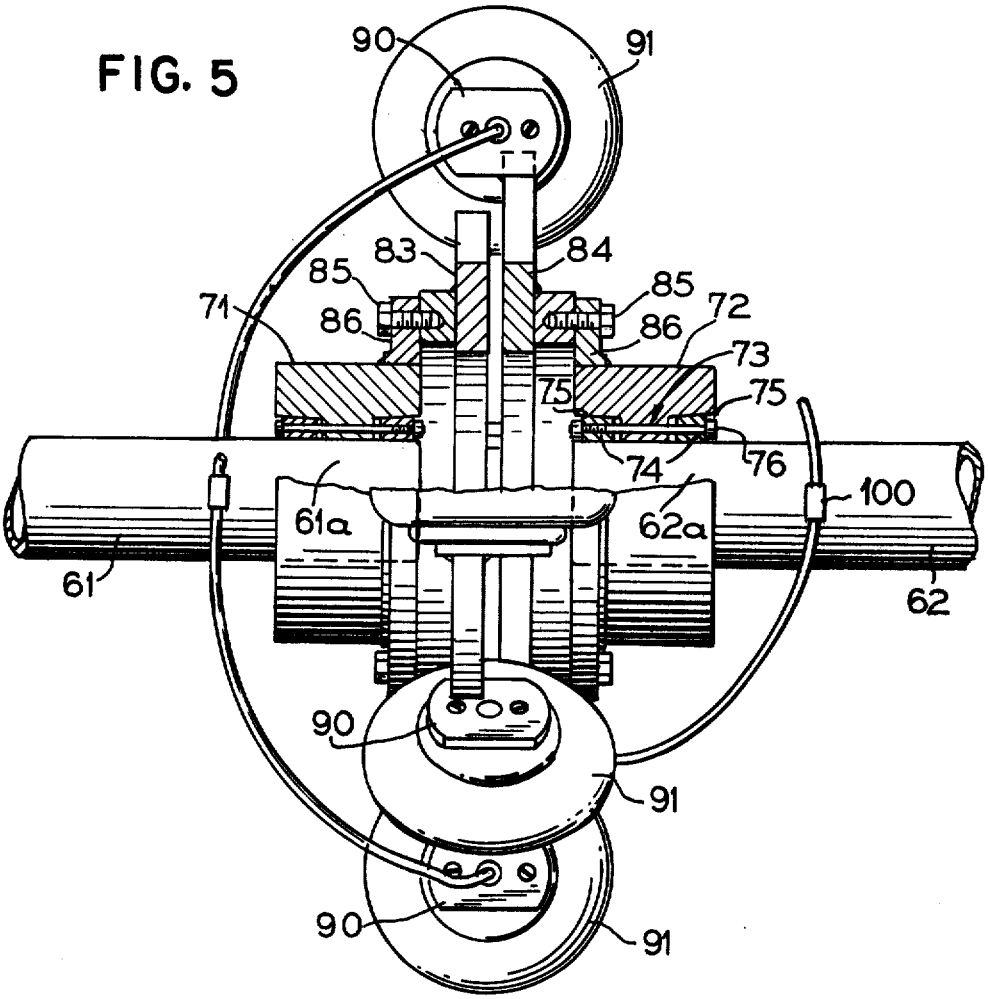
FIG. 5 is a partially sectional side view of the coupling of this invention.

As best illustrated in FIG. 5, each of the shafts 61, 62 has an end portion **61*a*, 62*a* affixed respectively to a base collar 71, 72 of the collar 70. The manner of affixing the base collars to the shafts is preferably one that allows considerable rotational adjustment between the shaft and the base collar. As illustrated in FIG. 5, this may take the form of a wedge clamp assembly 73 which includes wedge ring assemblies 74 received in counter bores 75 of the base collar 72 and drawable towards one another by means of bolts 76. Due to mating inclined faces between the counter bore and the wedge ring assembly 74, axial movement by tightening of the bolts 76 will enclamp the base collars 71, 72 to the respective surfaces of the shafts 61, 62. It can be seen that this type of an assembly allows for infinite rotational positioning of each base collar 72** with respect to its shaft.

Figure 3:
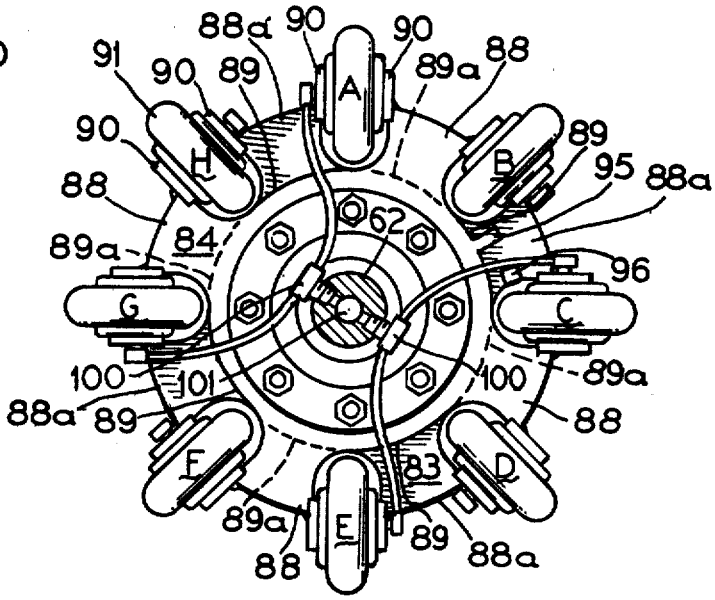
FIG. 3 is a sectional view along the lines II—II of FIG. 2.

Affixed to the base collar 71, 72 and projecting outwardly therefrom, in the preferred embodiment illustrated, are radially extending flange members 83, 84 which may be attached to the base collar 71, 72 by bolts 85 which in turn are received through brackets 86 welded to the base collar. The radially projecting flange members 83, 84 have variously configured outer diameters which, as best shown in FIG. 3, include circumferentially spaced projections 88 and intermediate circumferentially spaced troughs 89 with the projections 88 and troughs 89 of one flange 84 being circumferentially offset from the projections **88*a* and troughs 89*a* of the other flange member 83. Each of the projections has mounting pads 90 formed on its fore and aft leading and trailing edges defined by the troughs. The pads 90 serve as mounting bases for air bags 91 such that the air bags 91 are circumferentially entrapped between pads 90 of projections 88, 88*a* formed respectively on flanges 83 and 84. The air bags 91 extend radially inwardly into the troughs 88 of the flanges 83, 84**.

Alternately spaced air bags will be compressed or expanded by relative rotation between the shafts 61, 62 in either direction. As illustrated in FIG. 3, in an eight bag set, bags A, C, E and G will be expanded by relative clockwise rotation of radial flange 84 with respect to underlying radial flange 83 whereas bags B, D, F and H will be compressed. The opposite would occur with relative rotation counter clockwise of flange 84 with respect to underlying flange 83 with, in that instance, bags A, C, E and G being compressed and bags B, D, F and H being expanded.

If desired, circumferential abutment stops 95 and 96 may be formed on respectively the radial projections 83 and 84 to limit circumferential displacement of one radial projecting flange with respect to the other. As should be apparent to those skilled in the art, such projections can be provided to limit both relative rotational directional movements.

As will be appreciated from FIG. 3, the bags are therefore provided in two sets, bags A, C, E and G providing one set and bags B, D, F and H providing the other set, the sets being determined by which bags will be compressed and which bags will be expanded for either direction of relative rotation between shafts 61 and 62.

In order to provide for variability in the degree of torsional resistance, the sets can be inflated separately. Thus, the set consisting of bags A, C, E and G can be supplied with pressure gas by conduits 100 which are tapped to a single pressure line 101 which, in the embodiment illustrated, runs axially of shaft 62. Similarly, bags B, D, F and H are provided with pressure gas from conduits 103 supplied by an axial bore 104 through shaft 61. Rotational pressure fittings 105 and 106 at the outboard ends of shafts 62, 61 are coupled to separate pressure valving systems 107, 108 which include regulatable pressure valves 109, 110 supplied from separate or common high pressure sources "P". In this manner, a desired level of pressure can be provided to each set of bags. Although the sets are herein commonly provided with pressured air, it is to be understood that if desired a more complex pressure system could be provided allowing indiviudal variation of the individual bags or common pressure variation of any two or more bags.

For some types of air bags, as the bag is compressed, its diameter will increase thus increasing its effective area. When the bag is expanded or extended, the diameter decreases thus reducing the effective area. This variation in effective areas varies the spring rate.

Since the torsional resistance to rotation per increment of relative rotation between shafts 61 and 62 provided by collar assembly 70 will be determined by the pressure in the bags, and because the bag pressure is variable, it can be seen that a wide range of adjustability can be provided for the torsional resistance. For example, if, as illustrated in FIG. 2, shaft 62 is rotated relative to shaft 61 because the right hand end of rider roll 21 raises vertically greater than the left hand end of rider roll 21, the torque force applied by that rotation of shaft 62 to shaft 61, and the torsion counter force from shaft 61, will be dependent upon the air pressure in bags B, D, F and H, the bags being compressed by that relative rotation. Thus, the torsional resistance can be adjusted by adjusting the air pressure of those bags and increasing the air pressure, by adjustment of valve 110 to supply greater air pressure to those bags will increase the torque force transmission of the collar and will thereby have a tendency to increase the nip force at the right hand end of the winder assembly.

Conversely, if it is desired that the rider roll 21 assume a non-level position, adjustment of the air pressure in the respective bag sets can be utilized to accomplish that result by changing the relative neutral position of the collar assembly. That is by reducing the pressure in the bag set A, C, E and G, while increasing the pressure in the bag set B, D, F and H, it can be seen that the neutral position of the flanges 83 and 84 will be readjusted by a counter clockwise movement of flange 84 with respect to flange 83.

Figure 4:
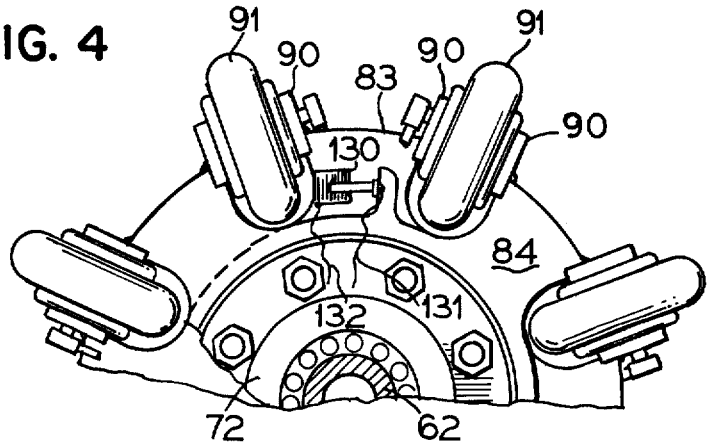
FIG. 4 is an enlarged fragmentary plan view of a portion of the variable spring rate coupling of this invention.

In order to provide for the desired degree of control, control of bag pressure can be automatically controlled at a common control center 120. That control center may, for example, have in-feeds 121, 122 from the valves 108, 107, and conversely can provide for control of those valves via the same or separate lines. Additionally, the nip force can be sensed directly from load cells 125, 126 positioned in the chain supports for the rider roll beam and that information can be provided to the control center by input lines 128, 129. Further, as shown in FIG. 4, the relative position of the flanges 84, 83 can be sensed. For example, a variable resistance potentiameter having a moving plunger 130 can be utilized to provide a variable resistance through lines 131, 132 which can be sensed by control 120 to determine the relative position between the radially projecting flanges, and therefore between shafts 61 and 62. All of this information can be utilized to adjust the pressure in the bag sets as desired to accomplish the desired control of the rider roll nip force across the width of the paper roll 15. Additionally, inasmuch as the presence of the bags provides for electrical isolation of the shafts, introduction of a low level potential between the shafts can be utilized to signal an overload when the shafts 61 and 62 have relatively rotated to a maximum desired extent. At that point, the abutment stops 95 and 96 will contact and an electric circuit can be closed by means of that contact.

The particular construction of the control is not illustrated herein inasmuch as such construction would, of necessity, vary according to the specific input sensors utilized and the degree of control desired to be exercised. It is, however, contemplated that both automatic and manual control systems and automatic systems having manual overrides and presets may be utilized. It is contemplated that the spring rate of the coupling could be controlled from between 10 pounds per inch to 4,000 pounds per inch. Other configurations could extend the range. Although I have illustrated herein an eight bag set, it is to be understood that a greater or lesser number of bags could be utilized. Moreover, although I have illustrated a collar assembly which places the bags at the far outer diameter of the assembly, other variations could be provided including bags that are positioned intermediate the inner and outer diameters of the collar assembly, and, even, in those instances utilizing extremely large shafts, bag sets that are provided within the outer diameter of the respective shafts. Moreover, although I have illustrated a collar that is received between the axial ends of two axially aligned shafts, it of course is possible to use telescoped shafts with the collar assembly being provided at one or both ends of the telescoped shaft assembly. In such a configuration, it would of course be possible to utilize two collar assemblies providing a greater range of control.

Due to the use of the variable spring rate coupling disclosed herein, the rider roll can be allowed to go out of level to conform to the tapered shape of a building roll if desired. Moreover, the rider roll can be forced to take an out of level position if desired and the coupling can be utilized to phase or bias the rider roll position. The actual out of level condition of the rider roll can easily be monitored by a sensing means such as disclosed herein and, further, due to the use of variable locks between the shafts and the collar bases, the actual positioning of the shafts 61, 62 relative to one another can be varied greatly, both facilitating maintenance of a level condition for the rider roll or, if desired, an out of level position. The versatility of this invention will be readily apparent to those of skill in the art.

Although the teachings of my invention have herein been discussed with reference to specific theories and embodiments, it is to be understood that these are by way of illustration only and that others may wish to utilize my invention in different designs or applications.

I claim as my invention:

1. In a rider roll assembly including an elongated rider roll, flexible elongated support means for each end of the rider roll, and torsion cross shaft means with the support means engaging the cross shaft means and effective to rotate the cross shaft means in response to movement of the rider roll, the improvement of the cross shaft means comprising first and second rotatable shaft portions interconnected by torque transmitting means having means for adjusting the torque transmitted per unit of relative rotational displacement of the shaft portions, the torque transmitting means including variable pressurizable air bags, and first and second base portions affixed to the first and second shaft portions with the base portions rotatably interconnected by variable pressurizable air bags, the air bags including a first set which undergoes compression during a relative rotation of the first shaft portion with respect to the second shaft portion in the first direction and including a second set which undergoes compression during a relative rotation of the first shaft portion with respect to the second shaft portion in a second direction opposite the first direction and including means for varying the pressurization of at least one of the first and second sets, the means for varying pressurization including conduits connecting a pressure gas source to the first and second sets with variable pressure setting valves associated with the conduits whereby pressure transmitted from the pressure gas source to the first and second sets can be individually controlled and wherein the conduits include rotatable couplings and the sets can be variably pressurized during operation of the assembly.

2. The assembly of claim 1 wherein means are provided to monitor the pressurization of the sets.

3. The assembly of claim 2 wherein second means are provided to monitor the relative rotation of the first shaft portion with respect to the second shaft portion.

4. The assembly of claim 3 wherein third means are provided for monitoring the nip pressure force exerted by the rider roll by monitoring tension in the support means.

5. The assembly of claim 4 wherein the at least one of the first, second and third means for monitoring provide an input to an automatic control for adjusting the variable pressure of the bag sets.

6. A winder roll assembly for winding rolls of material including a plurality of rotating winder drums, a roll core, means for guiding the roll core vertically with respect to the winder roll drums, a rider roll assembly including a rider roll engaging the roll of material being wound to urge the roll of material against the winder drums, a rider roll beam carrying the rider roll, guide means for the rider roll beam, support means for the rider roll beam, said support means including first and second chains affixed respectively adjacent first and second axial ends of the rider roll beam, a rotatable cross shaft having first and second sprockets non-rotatably affixed thereto, the first and second chains passing over the first and second sprockets and engaged therewith to impart a rotation to the cross shaft in dependent response to movement of the rider roll beam, said cross shaft including first and second shaft portions with one of said sprockets affixed to each of said shaft portions, said shaft portions interconnected by a torque transmitting variable spring rate collar, said collar including first and second base portions non-rotatably affixed respectively to said first and second shaft portions, first and second outwardly projecting flange portions affixed respectively to said first and second base portions, a plurality of circumferentially spaced air bags interconnecting said first and second flange portions, said air bags effective to transmit torque between said flange portions caused by relative rotation of said first and second shaft portions, a first set of said air bags being compressed by relative rotation of the first shaft portion with respect to the second shaft portion in a first direction, a second set of air bags being compressed by relative rotation of said first shaft portion with respect to said second shaft portion in a second direction opposite the first direction, means for individually pressurizing at least said first and second bag sets, said means for individually pressurizing including first and second pressure conduits in communication respectively with a source of pressure gas through first and second individually controllable pressure valves, and means for controlling the setting of the pressure valves, wherein the rotational positioning of the first and second base portions with respect to the first and second shaft portions is adjustably variable.

7. An assembly according to claim 6 including first means for monitoring the respective pressure of the first and second sets.

8. An assembly according to claim 7 including second means for monitoring the relative rotational displacement of the first shaft portion with respect to the second shaft portion.

9. An assembly according to claim 8 wherein the second means for monitoring displacement includes means for monitoring relative displacement of the first flange with respect to the second flange.

10. The assembly of claim 8 including third means for monitoring the stress load in the first and second support chains.

11. An assembly according to claim 10 wherein said means for monitoring providing inputs to control unit from at least one of said first, second and third means for monitoring for controlling the pressurization of the first and second air bag sets.

* * * * *